US005621980A

United States Patent [19]

Kingsbury

[11] Patent Number: 5,621,980

[45] Date of Patent: Apr. 22, 1997

[54] BLOW DRYER ATTACHMENT FOR VOLUMIZING AND STYLING HAIR

[76] Inventor: Daniel B. Kingsbury, 1071 Vineland St., Cocoa, Fla. 32927

[21] Appl. No.: 412,894

[22] Filed: Mar. 29, 1995

[51] Int. Cl.[6] ..... A45D 20/00

[52] U.S. Cl. ..... 34/97; 132/114; 392/379

[58] Field of Search ..... 34/96, 97, 98, 34/99, 101; 132/113, 118, 148, 271; 392/379, 380, 383–385; 239/133, 135, 556, 545

[56] References Cited

U.S. PATENT DOCUMENTS

| | | | |
|---|---|---|---|
| 1,252,499 | 1/1918 | Scheel | 132/114 |
| 1,431,948 | 10/1922 | Gee | 132/114 |
| 2,430,751 | 11/1947 | Woodyard et al. | 34/97 |
| 3,837,581 | 9/1974 | Orsoff | 34/97 |
| 3,860,174 | 1/1975 | Cercone . | |
| 4,230,279 | 10/1980 | Forsberg . | |
| 4,676,260 | 6/1987 | Paulhus et al. . | |
| 4,692,594 | 9/1987 | Martin . | |
| 4,759,135 | 7/1988 | Scivoletto . | |
| 4,955,145 | 9/1990 | Scivoletto . | |
| 4,999,928 | 3/1991 | Tozier . | |
| 5,091,630 | 2/1992 | Djuric . | |
| 5,235,759 | 8/1993 | Rizzuto, Jr. | 34/98 |

FOREIGN PATENT DOCUMENTS

| | | | |
|---|---|---|---|
| 2137407 | 1/1972 | Germany | 34/96 |
| 2508951 | 9/1976 | Germany | 392/379 |
| 91/08690 | 6/1991 | WIPO | 392/384 |

*Primary Examiner*—John T. Kwon

[57] ABSTRACT

A hair blow dryer attachment for styling and creating a greater volume of hair is comprised of a base from which a plurality of hollow members project. The base adapts the attachment to a hair blow dryer. The hollow members are arranged and spaced to facilitate insertion into hair to the base of the hair and to support the hair while drying. Each hollow member contains a plurality of apertures which are arranged to diffuse and deliver air from the blowdryer to hair at the base of the head, thus drying the hair at its base.

9 Claims, 2 Drawing Sheets

BLOW DRYER ATTACHMENT FOR VOLUMIZING AND STYLING HAIR

BACKGROUND OF THE INVENTION

1. Field of the Invention

The invention relates to an attachment for a hair blow dryer and more particularly to such an attachment which delivers air from the blow dryer to hair at the base of the hair while supporting and styling the hair during the drying process.

The hair blow dryer has become a common household and professional appliance for drying hair. In the art of styling hair, the hair dryer is employed to produce and direct a stream of air through a nozzle to dry the hair. The hair is styled in the desired fashion while being dried by the blow dryer. The hair conforms to the style in which it dries.

2. Description of the Prior Art

Heretofore, a variety of hair blow dryer attachments have been offered to facilitate the drying and styling process. These attachments may redirect or diffuse the blow dryer air, or grasp the hair to assist in styling.

One problem with the existing blow dryers and attachments is they are of a form that directs the blow dryer air onto the hair from sources outside the hair. The effect of such form is to cause the hair to be forced toward the head, resulting in a flattening of the hair. In the event that the hair is held extended with some lifting device, the surrounding hair not within the grasp of the lifting device succumbs to the flattening effect of the blowdryer air.

A second problem with existing blow dryers and attachments is they cannot deliver the drying air from the blowdryer to the hair at the base of the head. Because the base of the hair is not dried completely, the hair will not stand up due to limpness from residual moisture.

A third problem with certain existing art is the user typically must wear a helmet, bonnet, or other apparatus which is cumbersome, uncomfortable, immobilizing, and expensive.

BRIEF SUMMARY OF THE INVENTION

A blow dryer attachment for volumizing and styling hair is comprised of a base from which a plurality of hollow members project. The base adapts the attachment to a blow dryer. Each hollow member contains a plurality of apertures through which air from the blow dryer source is directed. The hollow members are arranged and spaced in a pick-like fashion to facilitate insertion into hair and aid in styling the hair. The apertures in the hollow members are arranged to diffuse the blow dryer air and to dry hair at the base of the hair.

The several problems with the prior art are overcome by my invention. Because the blow dryer air is directed into the hair from within the hair as opposed to onto the hair from outside, the flattening effect is avoided while, at the same time, a lifting and volumizing effect is produced. The pick-like shape of the invention lifts and holds the hair creating volume and holding style. The diffusing action of the hollow members and apertures reduces the force of the emitted blow dryer air, preventing the hair from being disturbed from the desired style while drying. The arrangement of the apertures allows the invention to rest on the scalp and thoroughly dry the hair at its base.

The invention overcomes the second problem of residual moisture at the base of the hair causing limpness by delivering the blow dryer air to the base of the hair. Thus, the base of the hair is dried thoroughly causing it to hold its shape and preventing flattening and limpness.

The third problem of cumbersomeness, discomfort, and immobilization of the user, and expense is overcome due to the simple, compact, and versatile nature of the invention.

Further objects and advantages of my invention will become apparent from a consideration of the drawings and ensuing description of it.

BRIEF DESCRIPTION OF THE DRAWINGS

In the accompanying drawings forming part of this specification.

OBJECTS OF THE INVENTION

Figure 1:
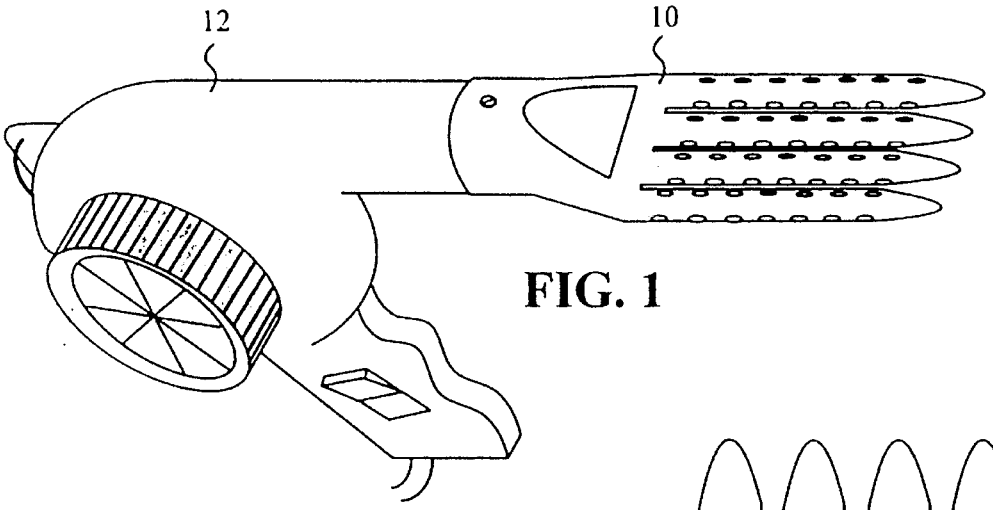
FIG. 1 is a prospective view of the attachment of the invention coupled to a conventional blow dryer.

10 blow dryer attachment for volumizing and styling hair
12 blow dryer
14 attachment portion
16 funneling portion
18 hollow members
20 apertures
22 hollow cone-shaped member
24 blow dryer output
26 attachment cylindrical portion
28 bore
30 screw
32 cylindrical portion
34 oval portion
36 closed end

DETAILED DESCRIPTION OF THE PREFERRED EMBODIMENTS

With reference now to the drawings, and in particular to FIGS. 1 through 6 thereof, a hair blow dryer air diffuser and hair volumizing attachment designated by the reference numeral 10 will be described.

FIG. 1 illustrates the blow dryer attachment for volumizing and styling hair 10 adapted for being attached to a blow dryer 12. Blow dryer 12 may be any conventional blow dryer which projects a column of air from its air exit.

Figure 2:
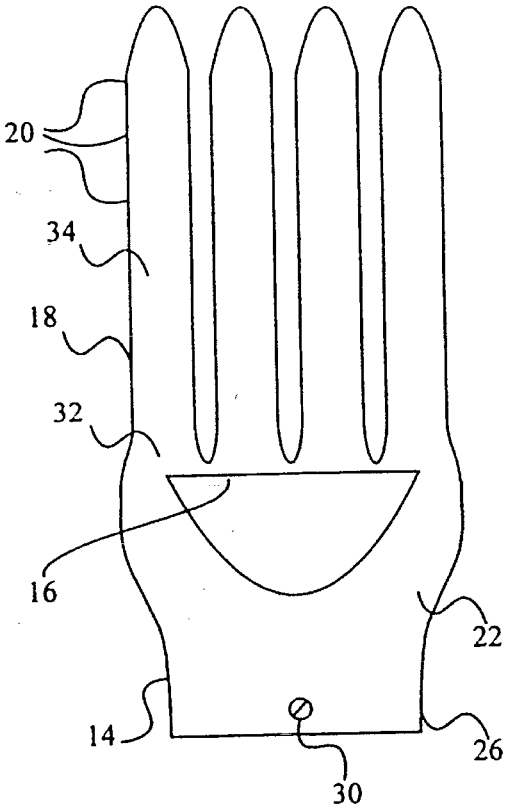
FIG. 2 is a plan top view of the invention.
Figure 3:
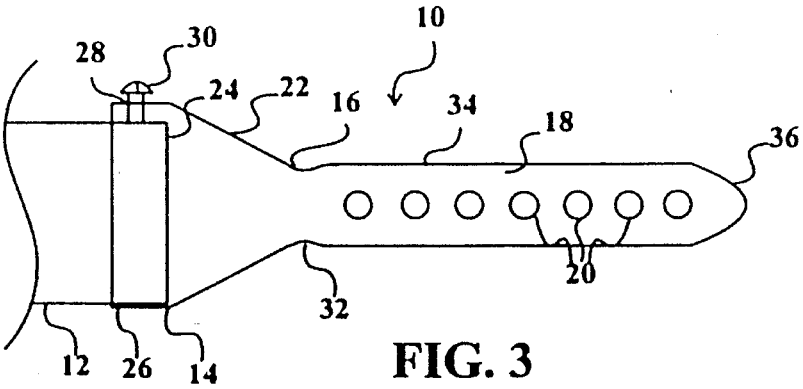
FIG. 3 is a plan side view of the invention.
Figure 4:
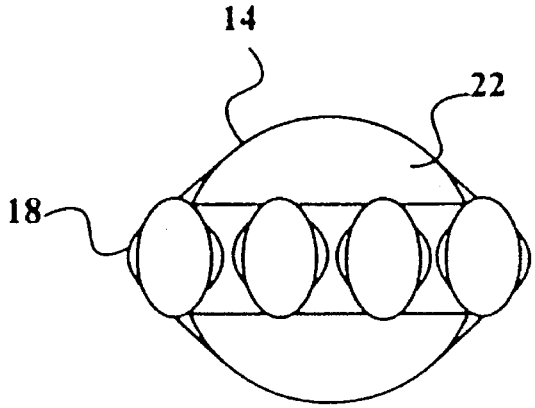
FIG. 4 is a plan front view of the invention.

Referring now to FIGS. 2, 3, and 4, attachment 10 includes three major portions which are referred to as the attachment portion 14, the funneling portion 16, and hollow members 18.

The attachment portion 14 includes an attachment cylindrical portion 26 adapted to fit over the output 24 of blow dryer 12. Attachment cylindrical portion 26 is designed to tightly fit the largest output 24 of conventional blow dryers and contains a bore 28 designed to accept screw 30. The screw 30 may be threaded into the bore 28 to a depth that will provide a tight fit on any blow dryer output 24 with a smaller diameter. Attachment cylindrical portion 26 transitions to a hollow cone shaped member 22, hollow cone shaped member 22 having converging opposite side walls terminating in funneling portion 16.

The attachment portion 14 just described is a universal attachment which may be used with many different blow dryers. The air from the blow dryer output 24 is thereby provided to the funneling portion 16 of hollow cone shaped member 22.

The air funneling portion 16 and hollow members 18 of attachment 10 will now be described. The purpose of air funneling portion 16 is to direct air from hollow cone shaped member 22 into hollow members 18. Hollow members 18 consist of a cylindrical portion 32 which transitions into a oval portion 34 and terminates in a closed end 36. The purpose of cylindrical portion 32 is to further funnel air emitted by funneling portion 16 into oval portion 34 of hollow members 18. The purpose of the oval shape of oval portion 34 is to facilitate insertion of the hollow members 18 into the hair and to act as a hair supporting and lifting apparatus. Closed end 36 is shaped to a rounded, cone shaped, or blade shaped termination which also facilitates insertion of hollow members 18 into the hair. A plurality of apertures 20 exists in oval portion 34. The apertures 20 are spaced to evenly disperse air throughout their length while allowing the bottom of the hollow tube shaped members 18 to be placed directly against the scalp.

The air emitted from blow dryer 12 thus enters attachment 10 through the interior of cone 22, is diffused and funneled by funneling portion 16 into hollow tube shaped members 18, and is further diffused and released by apertures 20.

Figure 5:
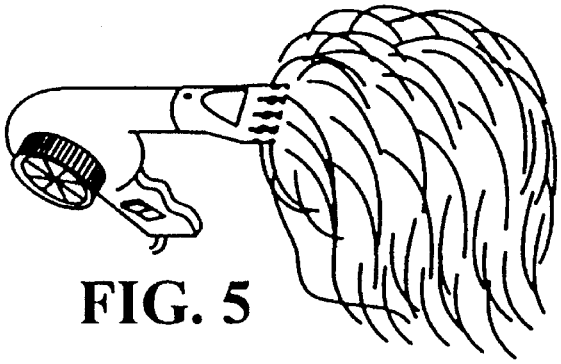
FIG. 5 is an artistic showing of the use of the invention.
Figure 6:
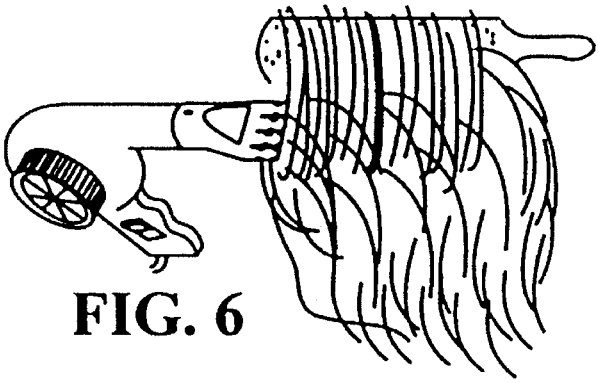
FIG. 6 is an artistic showing of use of the invention in conjunction with another styling tool.

In the operation of the invention, and with specific reference to FIGS. 5 and 6, the attachment 10 is attached to blow dryer 12 and inserted into a section of the hair at the base of the hair in the section being styled. The air from the blow dryer is emitted through the apertures 20 drying the hair at the base of the head. The desired fan speed and heat range are selected on blow dryer 12. The hair being styled may be lifted with the attachment 10 as in FIG. 5, or used in conjunction with other styling tools as shown in FIG. 6. The attachment 10 may be withdrawn and reinserted a number of times to facilitate the drying and styling process. This process of drying and styling continues until the hair is dry at its base, causing the hair to stand up and hold the volume and style desired. As the hair dries at its base, the attachment 10 may be moved outward toward the hair ends to complete the drying and styling process. The remaining sections of hair are dried in the aforementioned manner until the entire head of hair is dried and styled as desired.

Thus, the reader will see that the invention is a great improvement over the prior art, producing a greater volume of hair while holding desired styling. Not only is any flattening effect on the hair avoided, but greater volume is produced by the supporting of the hair by the invention and thorough drying of the base of the hair.

Although one detailed embodiment of the invention is illustrated in the drawings and previously described in detail, this invention contemplates any configuration, design, and relationship of components which will function in a similar manner and which will provide the equivalent result. As an example, the invention can be manufactured as an integral part of the blow dryer. As a second example, cylindrical portion 26 of attachment portion 14 may comprise a series of inside diameters, each designed to tightly fit consumer type hairdryers, beginning with the largest inside diameter at the inlet end and stepping down incrementally to the smallest inside diameter. As a third example, the attachment 10 may be attached to any appropriate supply of air by a flexible hose. Accordingly, the scope of the invention should be determined not only by the embodiments illustrated, but by the appended claims and their legal equivalents.

I claim:

1. An attachment for a blowdryer comprising:

a cylindrical attachment portion adapted to fit over an air output of the blowdryer, the cylindrical attachment portion transitioning to, and attached to a large base end of, a hollow cone-shaped member, the cone-shaped member terminating in a funneling portion;

a plurality of hollow members extending from the funneling portion in a direction parallel to the direction of airflow through the cylindrical attachment portion and cone-shaped member, each hollow member having a plurality of apertures to allow air to exit the hollow members.

2. An attachment for a blowdryer as recited in claim 1, wherein the attachment is one integrally molded piece.

3. An attachment for a blowdryer as recited in claim 1, wherein said hollow members are shaped so as to facilitate insertion of said hollow members into hair which is being dried.

4. An attachment for a blowdryer as recited in claim 3, wherein said hollow members are oval-shaped.

5. An attachment for a blowdryer as recited in claim 1, wherein said hollow members include a closed end, said closed end being shaped so as to facilitate insertion of said hollow members into hair which is being dried.

6. An attachment for a blowdryer as recited in claim 5, wherein said closed end is rounded.

7. An attachment for a blowdryer as recited in claim 5, wherein said closed end is cone-shaped.

8. An attachment for a blowdryer as recited in claim 1, wherein said apertures are evenly spaced along said hollow members.

9. An attachment for a blowdryer as recited in claim 1, wherein said apertures are disposed on the sides of the hollow members.

* * * * *